United States Patent [19]

Motomiya

[11] 4,438,931

[45] Mar. 27, 1984

[54] GOLF CLUB HEAD

[75] Inventor: Tetsuo Motomiya, Tsubame, Japan

[73] Assignee: Kabushiki Kaisha Endo Seisakusho, Tsubame, Japan

[21] Appl. No.: 418,636

[22] Filed: Sep. 16, 1982

[51] Int. Cl.[3] ..... A63B 53/04

[52] U.S. Cl. ..... 273/167 H; 273/80.2

[58] Field of Search ..... 273/167 H, 169, 173, 273/174, 167 R, 167 A, 167 B, 167 C, 167 E, 167 F, 167 G, 167 J, 167 K, 168, 170, 171, 172, 175, 80–80.9

[56] References Cited

U.S. PATENT DOCUMENTS 1,968,092 7/1934 Oldham ..... 273/169

4,313,607 2/1982 Thompson ..... 273/167 H

*Primary Examiner*—George J. Marlo

*Attorney, Agent, or Firm*—Keiichi Nishimura

[57] ABSTRACT

A golf club head comprising two or more thin shell sections, for instance a front shell section and a rear shell section, or a face shell section, a top shell section and a body shell section including a bottom section and a side section, are secured together along their edges to form a one-piece shell having a sealed space. A shaft is also secured together with the shell sections when securing these sections. The sealed space is filled with a filler material such as foamed urethane and rubber.

10 Claims, 5 Drawing Figures

GOLF CLUB HEAD

BACKGROUND OF THE INVENTION

1. Field of the Invention

This invention relates to a golf club head.

2. Prior Art

U.S. Patent Application Ser. No. 919,424 filed June 26, 1978 discloses a gold wood club head. This golf club head is not hollow but is filled with a filling material so that it is heavy and inconvenient to handle. In addition, it makes use of the elasticity of wood, so that it is rather inferior in the elasticity, and the ball shot by this club head cannot cover a great distance.

To overcome this drawback, a hollow club head made of metal has recently been produced by a lost wax method using a wax mold in order to replace the wood club. However, the club head produced by the lost wax method is prone to pinholes and cracks. In addition, the manufacture is rather difficult.

SUMMARY OF THE INVENTION

Accordingly, a general object of the invention is to provide a hollow golf club head made of metal, which is free from pinholes and cracks and has excellent quality so that it can replace the prior art wood club.

Another object of the invention is to provide a golf club head, which can be obtained in the principles underlying the invention by welding together edges of two or more thin sections of a club head shell made of metal such as stainless steel thereby producing a one-piece shell having a sealed space.

A further object of the invention is to provide a golf club head, which is free from pinholes and cracks, has accurately curved face and accurate thickness and is light in weight by forming the individual shell sections by means of press forging.

BRIEF DESCRIPTION OF THE DRAWINGS

The above and further objects and features of the invention will become more apparent from the following description with reference to the drawings, in which like reference numerals designate like parts.

DETAILED DESCRIPTION OF THE PREFERRED EMBODIMENTS

Figure 1:
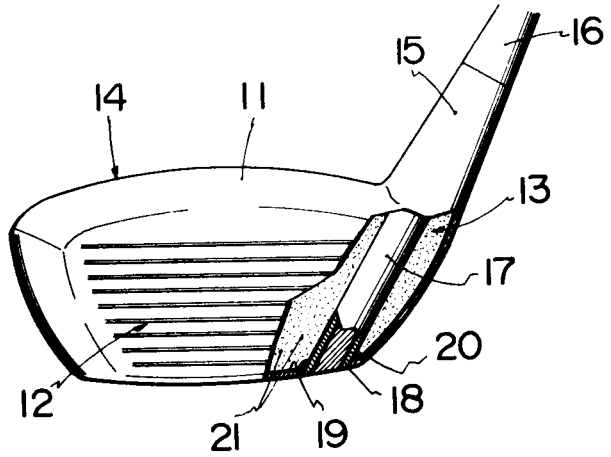
FIG. 1 is a front view, partly broken away, showing an embodiment of the invention.

FIG. 1 shows a golf club head 11, having a face section 12. The club head has a hollow sealed structure 13, and it is generally designated at 14.

The golf club head 14 has a stem or shaft mounting section 15. A lower end portion 17 of a shaft 16 is inserted in the shaft mounting section 15 and is secured thereto. The lower end 18 of the lower end portion 17 of the shaft 16 is secured to a bottom section 19 of the golf club head 14 by means of welding or adhesive such that it constitutes part of the bottom section 19.

Desirably, the sealed space 13 may be filled with an elastic filler material 21 such as foamed urethane and rubber.

The shell of the golf head 14 is obtained by welding together edges of two or more thin metal shell sections formed by means of press forging such as to form a one-piece shell structure having a sealed space as shown in FIGS. 2 to 5.

Figure 2:
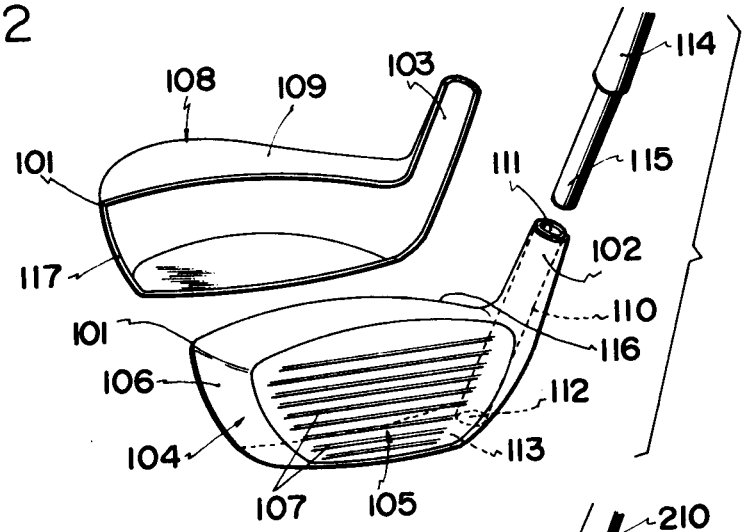
FIG. 2 is an exploded perspective view showing two shell sections, namely a front shell section and a rear shell section, to be welded together to obtain a first embodiment of a club head.

FIG. 2 shows a first embodiment of the invention. In this embodiment, the club head is formed from two shell sections, namely a front shell section 104 and a rear shell section 108. These shell sections 104 and 108 are divisions of the club head that would be obtained by splitting the club head along a longitudinal and vertical plane including a toe 101 and shaft mounting section 102, 103. The front shell section 104 includes a face section 105, a side section 106 and a shaft mounting section 102. The face section 105 includes horizontal parallel grooves 107 formed at a suitable interval. The rear shell section 108 includes a back section 109 and the shaft mounting section 103. The front and rear shell sections 104 and 108 are thin shell sections formed separately by means of press forging. Designated at 110 is a shaft mounting pipe, which has its upper portion 111 secured by means of welding to the shaft mounting sections 102 and 103 of the front and rear shell sections 104 and 108. The lower end 112 of the shaft mounting pipe 110 is secured by means of welding to the bottom section 113 of the front section 104. A lower portion 115 of a shaft 114 is inserted in the shaft mounting pipe 110 and secured thereto. The edges 116 and 117 of the front and rear sections 104 and 108 are secured together by means of welding, thus forming a one-piece shell.

The filler material 21 such as foamed urethane shown in FIG. 1 may be introduced into the sealed space in the shell that is obtained by welding together the front and rear sections. More particularly, after the sections have been welded together, a small hole is formed in the shell and the filler material is poured into the shell through the small hole. The method of introducing the filler material 21 such as foamed urethane also applys to following embodiments of FIGS. 3 to 5.

Figure 3:
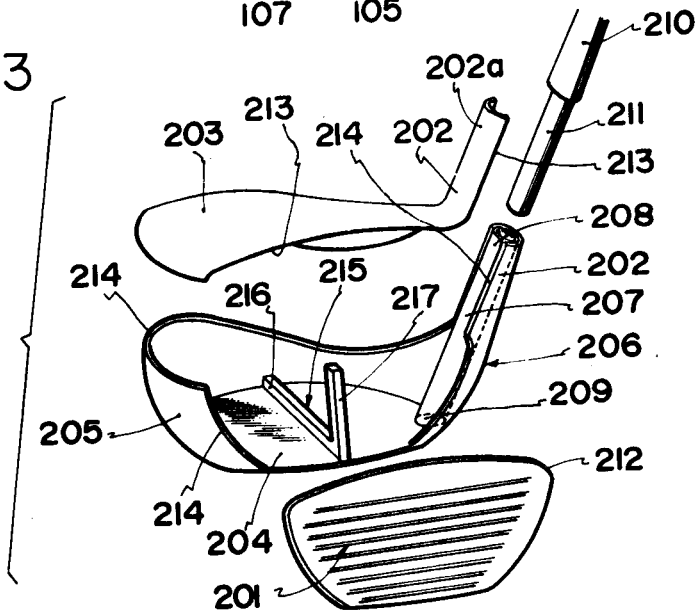
FIG. 3 is a exploded perspective view showing three shell sections, namely a face shell section, a top shell section and a body shell section, to be welded together to obtain a second embodiment of the club head.

FIG. 3 shows a second embodiment. This embodiment of the club head is formed from three shell sections, namely a face shell section 201, a top shell section 203 including a side portion **202*a* of a shaft mounting section 202, and a body shell section 206 including a bottom section 204, a side section 205 and a remaining side portion 202*b* of the shaft mounting section 202. The individual shell sections are again separately formed by means of press forging. An upper portion 208 of a shaft mounting pipe 207 is secured by means of welding to the shaft mounting section 202. A lower end 209 of the shaft mounting pipe 207 is secured by means of welding to the bottom section 204. A shaft 210 has its lower portion 211 inserted in the shaft mounting pipe 207** and secured thereto.

The face shell section 201, top shell section 203 and body shell section 206 are secured together by means of welding along their edges 212, 213 and 214, thus forming a one-piece shell having a sealed space.

Before welding together the individual sections, an L-shaped reinforcing member 215 is secured at its portion 216 to the bottom section 204. The face shell section 201 is then secured to the body section 206 with its inner surface secured to the other portion 217 of the reinforcing member 215 and then a top shell section 203 is secured. The reinforcing member 215 may not be of the L-shaped form, and it is possible to use a channel-shaped or T-shaped reinforcing member as well.

Figure 4:
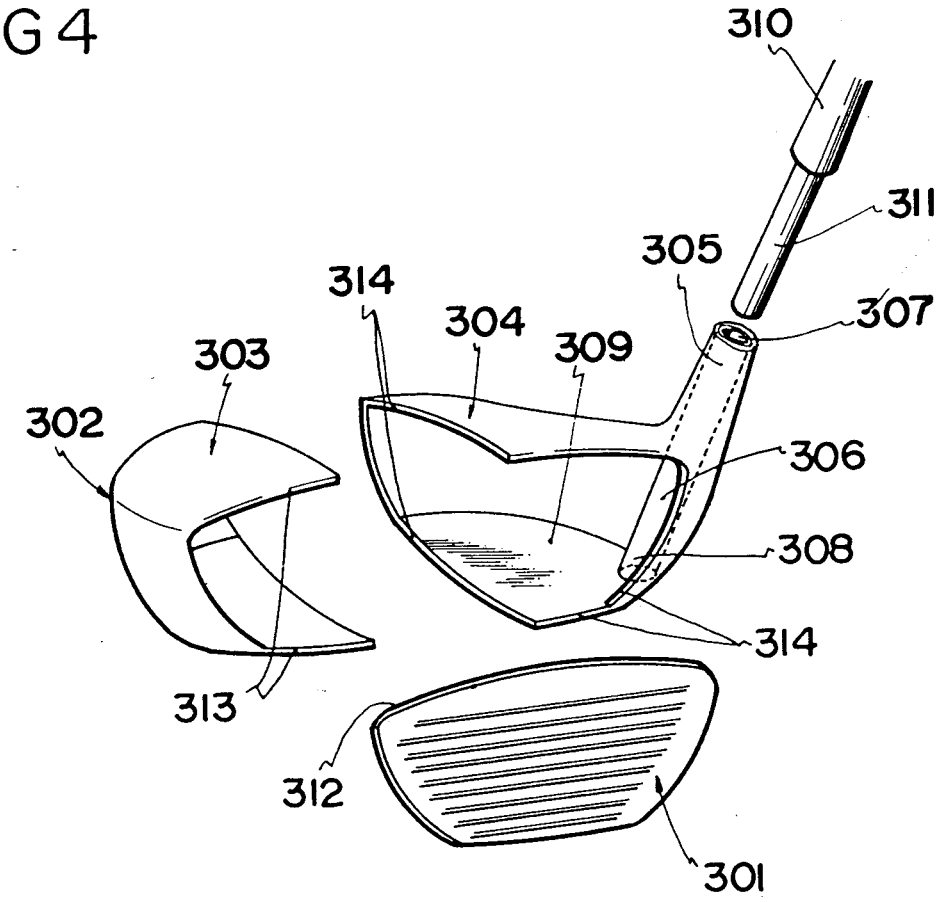
FIG. 4 is an exploded perspective view showing three shell sections, namely a face shell section, a toe shell section and a stem shell section, to be welded together to obtain a third embodiment of the club head.

FIG. 4 shows a third embodiment. This embodiment of the club head is formed from three shell sections, namely a face shell section 301, a toe shell section 303 without the face section 301 and a stem shell section 304 without the face section 301. These shell sections are again separately formed by means of press forging.

A shaft mounting pipe 306 has its upper portion 307 secured by means of welding to a shaft mounting section 305 in the stem shell section 304. A lower end 308 of the shaft mounting pipe 306 is secured by means of welding to a bottom section 309 of the stem shell section 304. A lower portion 311 of a shaft 310 is inserted in the shaft mounting pipe 306 and secured thereto like the preceding embodiments of FIGS. 2 and 3.

The face shell section 301, toe shell section 303 and stem shell section 304 are secured together by means of welding along their edges 313, 314 and 315, thus forming a one-piece shell having a sealed space.

Figure 5:
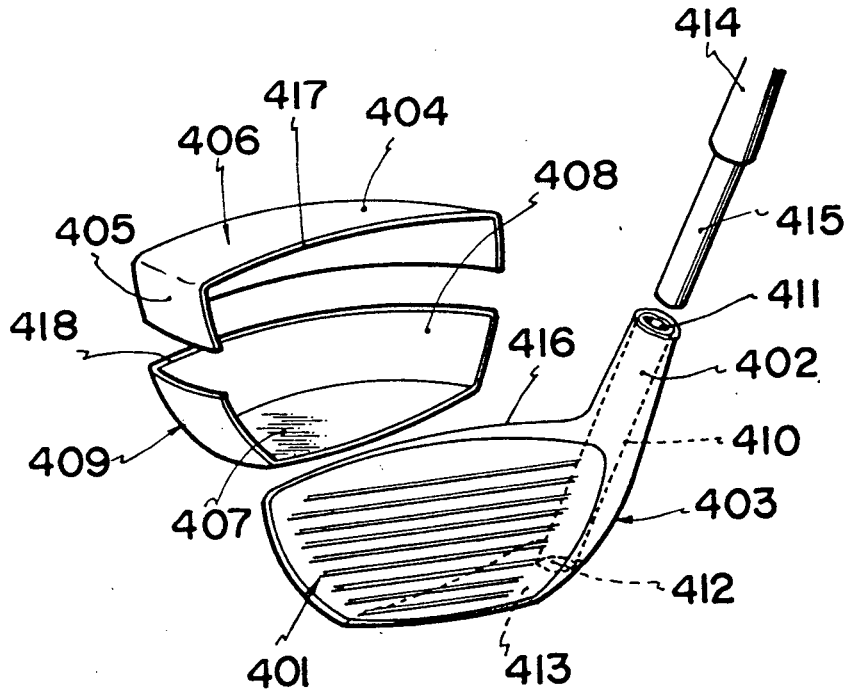
FIG. 5 is an exploded perspective view showing three shell sections, namely a face shell section, an upper rear body shell section and a lower rear body shell section, to be welded together to obtain a fourth embodiment of the club head.

FIG. 5 shows a fourth embodiment. This embodiment of the club head is formed from three shell sections, namely a front shell section 403 including a face section 401 and a shaft mounting section 402, an upper rear shell section 406 including a top section 404 and an upper side section 405, and a lower rear shell section 409 including a bottom section 407 and a lower side section 408. These shell sections are again separately formed by means of press forging.

A shaft mounting pipe 410 has its upper portion 411 secured by means of welding to the shaft mounting section 402. A lower end 412 of the shaft mounting pipe 410 is secured by means of welding to a bottom section 413 of the front shell section 403. A lower portion 415 of a shaft 414 is inserted in the shaft mounting pipe 410 and secured thereto.

The front shell section 403, top section 404 and lower rear shell section 409 are secured together by means of welding along their edges 416, 417 and 418, thus forming a one-piece shell structure having a sealed space.

With the construction described in the foregoing, it is possible to obtain the following excellent effects over the prior art.

The invention is not based on the lost was process, but according to the invention two or more thin shell sections, namely the front shell section 104 and rear shell section 108 in the embodiment of FIG. 2, top shell section 203, side section 205 and body shell section 206 in the embodiment of FIG. 3, face shell section 301, toe shell section 303 and stem shell section 304 in the embodiment of FIG. 4 and front shell section 403 and upper rear shell section 406 and lower rear shell section 409 are separately produced by means of press forging and are secured together by means of welding along their edges 116 and 117, 212, 213 and 214, 312, 313 and 314 and 416, 417 and 418, thereby forming a one-piece shell structure having a sealed space. Thus, it is possible to provide a high quality golf club head without the possibility of generation of pinholes and cracks in the individual component sections of the golf club head.

Further, since the face section 105, 201, 301 and 401 are formed by means of press forging, it is possible to obtain a precisely curved surface. Thus, a golf club head having an increased sweet area can be obtained.

Since the sections 104 and 108, 203, 205 and 206, 301, 303 and 304 and 403, 406 and 409 in the embodiments of FIGS. 2 to 5 are formed separately by means of press forging, they can be formed to have a very small thickness. Thus, it is possible to provide a golf club which is light in weight compared to the prior art golf club. Also it is possible to provide a golf club which is so light in weight that a woman who is comparatively physically weak can make a full swing.

Further, while the manufacture of the prior art golf club required comparatively high skill, according to the invention no substantial skill is required for the individual shell sections are separately produced by means of press forging so that it is possible to manufacture the golf club on a mass production scale.

According to the present invention still further, the upper and lower parts of the lower end portion 17 are firmly affixed to the shaft moving section 15 and the bottom section 19, respectively, as shown in FIG. 1. Alternatively, as shown in FIGS. 2–5, a shaft mounting pipe 110, 207, 306 or 410 is provided between the shaft mounting section 102, 103, 202, 305 or 402 and the bottom section 113, 204, 309 or 413, and the lower end portion 115, 211, 311 or 415 is inserted into this shaft mounting pipe so that the attached shaft can be fastened not only at the upper section of the golf club head but along the entire length from the upper section to the lower section. This contributes an added strength to the attachment of the shaft.

Moreover, since the bottom section of the lower end portion 17 can be affixed at any point on the bottom section 19 and, similarly, the bottom part of the shaft mounting pipe 110, 207, 306 or 410 can easily be affixed at any point on the bottom section 113, 204, 309 or 413, face progression (i.e., the distance between the face section and the shaft) which contributes importantly to hooking and slicing can be freely adjusted.

According to the present invention, furthermore, the face shell section 201 or 301 forms a single surface and is welded to the main body of the golf club head along its edge 212 or 312 so that fine adjustments of the loft angle, or the angle of inclination of the face section, can be made at the time of manufacturing. In other words, the golf club heads of the present invention allow fine adjustments of the inclination angle of the face section which also contributes heavily to hooking and slicing.

What is claimed is:

1. A golf club head comprising two or more sheet-like shell sections secured together edgewise to form a one-piece sealed hollow shell structure having a shaft mounting section and a bottom section, and a shaft, the lower end of which is fastened both to said shaft mounting section and to said bottom section.

2. A golf club head according to claim 1, wherein said two or more shell sections are a front shell section and a rear shell section.

3. A golf club head according to claim 1, wherein said two or more shell sections are a face shell section, a top shell section and a body shell section, said body shell section including a bottom shell section and a side shell section.

4. A golf club head accordiing to claim 3, further comprising an L-shaped reinforcing piece between said face shell section and said bottom shell section.

5. A golf club head according to claim 1, wherein said shell sections are made of a metal.

6. A golf club head according to claim 1, wherein said shell structure contains a filler material.

7. A golf club head according to claim 6, wherein said filler material is foamed urethane.

8. A golf club head according to claim 6, wherein said filler material is rubber.

9. A golf club head according to claim 1, wherein said shell sections are made of stainless steel.

10. A golf club head according to claim 1, further comprising a pipe extending between said shaft mounting section and said bottom section, the lower end of said shaft being inserted into said pipe.

* * * * *